US010928169B2

(12) United States Patent
Wurzel et al.

(10) Patent No.: US 10,928,169 B2
(45) Date of Patent: Feb. 23, 2021

(54) SEAL FOR A PROJECTILE GUIDING KIT

(71) Applicant: BAE Systems Rokar International Ltd., Jerusalem (IL)

(72) Inventors: Gil Wurzel, Maas (IL); Tsafrir Keynan, Modiin (IL); Ziv Moshkovitz, Ein-Ayala (IL)

(73) Assignee: BAE Systems Rokar International Ltd., Jerusalem (IL)

( * ) Notice: Subject to any disclaimer, the term of this patent is extended or adjusted under 35 U.S.C. 154(b) by 0 days.

(21) Appl. No.: 16/782,286

(22) Filed: Feb. 5, 2020

(65) Prior Publication Data

US 2020/0292289 A1 Sep. 17, 2020

Related U.S. Application Data

(63) Continuation-in-part of application No. 16/535,385, filed on Aug. 8, 2019, now Pat. No. 10,557,694.

(30) Foreign Application Priority Data

Feb. 7, 2019 (IL) ..... 264739

(51) Int. Cl.
*F42B 10/46* (2006.01)
*F42B 10/00* (2006.01)
*F42B 10/64* (2006.01)

(52) U.S. Cl.
CPC ..... *F42B 10/46* (2013.01); *F42B 10/00* (2013.01); *F42B 10/64* (2013.01)

(58) Field of Classification Search
CPC ..... F42B 10/00; F42B 10/46; F42B 10/42; F42B 10/64
See application file for complete search history.

(56) References Cited

U.S. PATENT DOCUMENTS 3,971,024 A * 7/1976 Clark, Jr. ..... H01Q 1/281 343/872
4,459,725 A * 7/1984 Mariaux ..... F42B 10/46 86/51
4,756,492 A * 7/1988 Kranz ..... F42B 10/62 244/3.1

(Continued)

OTHER PUBLICATIONS

Notice of Allowance for U.S. Appl. No. 16/535,385, dated Oct. 23, 2019.

*Primary Examiner* — J. Woodrow Eldred
(74) *Attorney, Agent, or Firm* — Pearl Cohen Zedek Latzer Baratz LLP

(57) ABSTRACT

A device for improving the aerodynamic feature of a projectile is disclosed. The projectile has a front part and a rear part. The external diameter of the front part of the projectile is larger than the external diameter of the front end of a rear part of the projectile. The front end of the rear part of the projectile is conical having larger diameter at locations behind the front end. The device comprises an annular cut-off cone sleeve slidably disposable over the front part of the projectile. The diameter of the narrower end of the annular cone sleeve is slightly larger than the diameter of the front part of the projectile and the length of the annular cut-off cone sleeve is larger than the distance between the front end of the rear part of the projectile and a location on rear part having a diameter equal to the diameter of the rear end of the annular cut-off cone sleeve.

8 Claims, 15 Drawing Sheets

(56) References Cited

U.S. PATENT DOCUMENTS

| | | | | |
|---|---|---|---|---|
| 8,069,790 | B1 | 12/2011 | Melkers | |
| 9,021,961 | B1 * | 5/2015 | Manole | F42B 10/44 102/439 |
| 2008/0315032 | A1 | 12/2008 | Harnoy | |
| 2012/0048992 | A1 | 3/2012 | Malul et al. | |
| 2013/0193264 | A1 * | 8/2013 | Cohe | F42B 10/46 244/3.16 |
| 2015/0247715 | A1 | 9/2015 | Wurzel et al. | |

* cited by examiner

Cross-section AA':

SEAL FOR A PROJECTILE GUIDING KIT

CROSS REFERENCE TO RELATED APPLICATIONS

This application is a Continuation-in-Part of U.S. patent application Ser. No. 16/535,385, filed on Aug. 8, 2019 and entitled SEAL FOR A PROJECTILE GUIDING KIT AND METHOD OF ASSEMBLING AND OPERATION, which claims the benefit of Israeli Patent Application No. 264739, filed on Feb. 7, 2019, which are incorporated in its entirety herein by reference.

FIELD OF THE INVENTION

The present invention relates to the field of projectile guiding kits, and more particularly, to sealings for the projectile guiding kits.

BACKGROUND OF THE INVENTION

Some current projectile guiding kits include a rear unit adapted to be connected at its rear end to a front end of a projectile and a front unit rotatably connected at its rear end to a front end of the rear unit. Typically, there is a small gap between the rear unit and the front unit to ensure uninterrupted relative rotation of the front unit with respect to the rear unit. These guiding kits typically include one or more bearings assembly positioned in, or proximal to, the gap between the rear unit and the front unit to enable the rotation of the front unit with respect to the rear unit.

In order to ensure proper operation of these guiding kits upon firing of the projectile, it is necessary to prevent dust and/or dirt from entering the gap and dirt the bearing(s). Accordingly, these guiding kits typically include a covering that is adapted to cover the gap between the rear unit and the front unit of the kit while the projectile is not in use.

Typically, the coverings thereof have to be manually removed from the kit, for example prior to feeding the projectile into a firing chamber of a weapon. This operation may be time consuming (especially when large number of projectiles or fast firing are needed) and/or may prevent using such projectile guiding kits with projectiles for automatic weapons. Furthermore, dust and dirt accumulated within the firing chamber of the weapon may also enter the gap and dirt the bearing(s) of the guiding kit.

Accordingly, there is a need in a device for sealing projectile guiding kits during the entire life time of the kit prior to the commencing of the relative rotation following the actual firing of the projectile.

SUMMARY OF THE INVENTION

One aspect of the present invention provides a device for improving the aerodynamic feature of a projectile. The projectile is having a front part and a rear part. The external diameter of the front part of the projectile is larger than the external diameter of the front end of a rear part of the projectile. The front end of the rear part of the projectile is conical having larger diameter at locations behind the front end. The device comprising an annular cut-off cone sleeve slidably disposable over the front part of the projectile. The diameter of the narrower end of the annular cone sleeve is slightly larger than the diameter of the front part of the projectile and the length of the annular cut-off cone sleeve is larger than the distance between the front end of the rear part of the projectile and a location on rear part having a diameter equal to the diameter of the rear end of the annular cut-off cone sleeve.

In some embodiments the annular cut-off cone sleeve is adapted to slide from a rearmost position backwardly in response to longitudinal firing acceleration force.

In some embodiments the annular cut-off cone sleeve is adapted to slide from a rearmost position backwardly in response to manually operated force.

In some embodiments the annular cut-off cone sleeve comprises a dent made in its internal face at a location facing against the rear end of the front part of the projectile when the cone sleeve is in its frontmost position.

In some embodiments the device further comprising a secure-and-lock ring disposed between the front part and the rear part of the projectile, the secure-and-lock ring comprises at least one lug protruding from the ring outer circumference.

In some embodiments the at least one dent is located in the dent of the cone sleeve when the cone sleeve is in its frontmost position.

In some embodiments the at least one dent is adapted to bent in response to sliding of the cone sleeve backwardly.

In some embodiments the at least one dent is adapted to touch the inner face of the cone sleeve when it is bent in a defined angle.

BRIEF DESCRIPTION OF THE DRAWINGS

For a better understanding of embodiments of the invention and to show how the same can be carried into effect, reference will now be made, purely by way of example, to the accompanying drawings in which like numerals designate corresponding elements or sections throughout.

In the accompanying drawings.

Figure 1A:
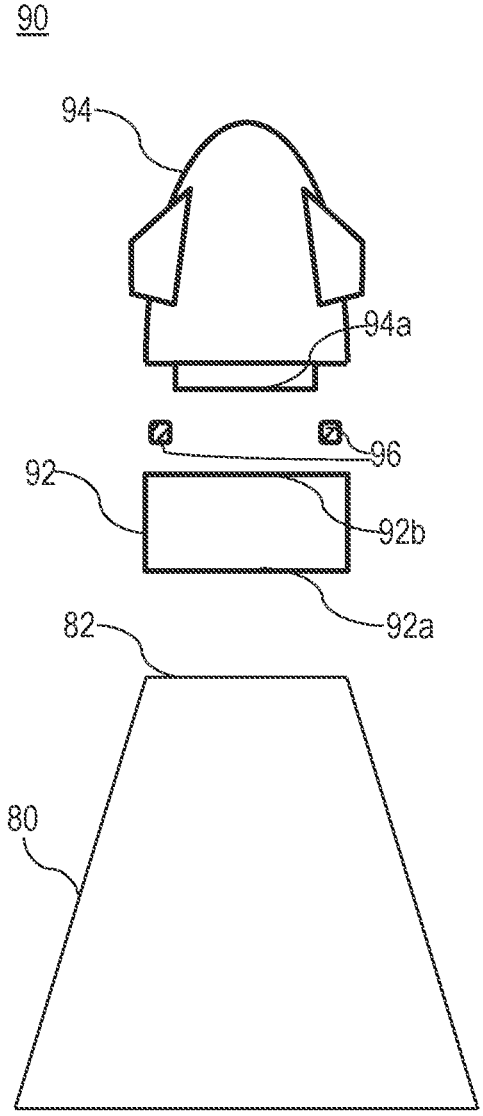
PRIOR ART Fig. 1A
FIGS. 1A and 1B are schematic illustrations of a projectile guiding kit for a projectile.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following description, various aspects of the present invention are described. For purposes of explanation, specific configurations and details are set forth in order to provide a thorough understanding of the present invention. However, it will also be apparent to one skilled in the art that the present invention can be practiced without the specific details presented herein. Furthermore, well known features can have been omitted or simplified in order not to obscure the present invention. With specific reference to the drawings, it is stressed that the particulars shown are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention can be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments that can be practiced or carried out in various ways as well as to combinations of the disclosed embodiments. Also, it is to be understood that the phraseology and terminology employed herein is for the purpose of description and should not be regarded as limiting.

The terms "front" and "rear" as used herein represent orientation of the disclosed devices/kits with respect to a projectile to be used with, and specifically, these relative directions/locations relate to the direction of flight of the projectile, when fired, as "forward".

Generally, a device for sealing a projectile guiding kit is disclosed. Some projectile guiding kits may include a rear unit adapted to be connected at its rear end to a front end of a projectile and a front unit rotatably connected at its rear end to a front end of the rear unit. The kits may include one or more bearings positioned in, or proximal to, a gap between the rear unit and the front unit to enable the rotation of the front unit with respect to the rear unit.

The disclosed device may be adapted to seal the gap between the rear unit and the front unit of the projectile guiding kit for the entire life time of the guiding kit/projectile prior to actual firing of the projectile. The device may be adapted to slide towards the rear unit of the guiding kit upon firing of the projectile, when the device is subjected to a longitudinal acceleration that exceeds a predetermined acceleration value and/or when subjected to a longitudinal aerodynamic force that exceeds a predetermined longitudinal force value. The sliding thereof may uncover the gap between the rear unit and the front unit of the guiding kit, thereby enabling uninterrupted rotation of the front unit with respect to the rear unit according to the aerodynamic forces applied thereon and provide proper operation of the kit thereof.

Advantageously, the disclosed device need not be removed from the guiding kit prior to firing of the projectile. For example, the projectile may be fed into a firing chamber of a weapon without detaching/releasing the device from the guiding kit. Accordingly, the disclosed device may seal sensitive elements of the projectile guiding kit (such as bearing(s) between the rear unit and the front unit thereof) all the way up to actual firing of the projectile. Furthermore, the disclosed device may save time and reduce personnel's effort required to prepare the projectile for firing and/or enable usage of the guiding kit with projectiles in automatic weapons. This is in contrast to current covering for the projectile guiding kit that has to be manually released/detached from the guiding kit prior to feeding the projectile into the weapon's firing chamber.

Figure 1B:
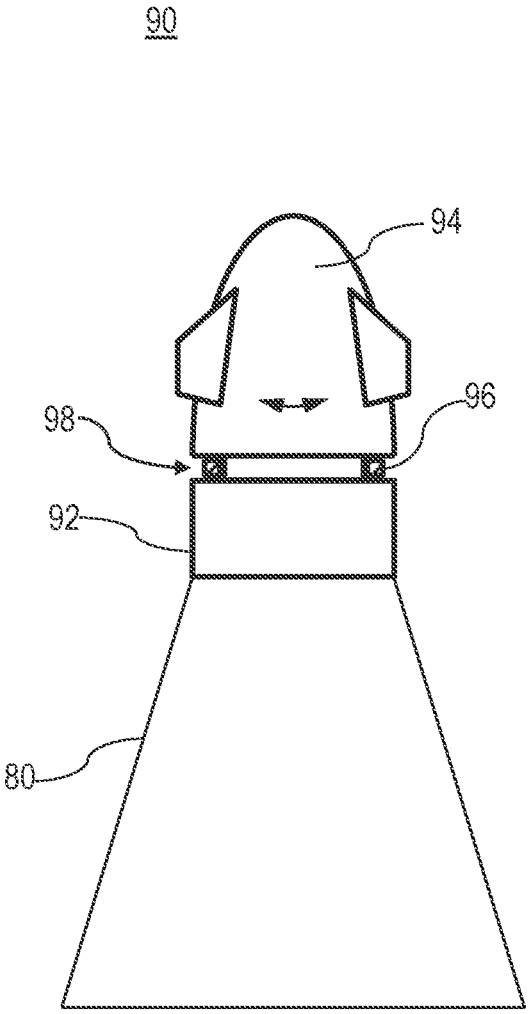
PRIOR ART Fig. 1B

Reference is now made to FIGS. 1A and 1B, which are schematic illustrations of a projectile guiding kit 90 for a projectile 80. FIG. 1A shows and exploded side view and FIG. 1B shows an assembled side view of guiding kit 90.

Projectile guiding kit 90 may have a rear unit 92 adapted to be connected at its rear end 92*a* to a front end 82 of a projectile 80 and a front unit 94 rotatably connected at its rear end 94*a* to a front end 92*b* of rear unit 92. Projectile guiding kit 90 may have one or more bearings 96 positioned within, or proximal to, a gap 98 between rear unit 92 and front unit 94 to enable the rotation of front unit 94 with respect to rear unit 92.

Reference is now made to FIGS. 2A, 2B, 2C and 2D, which are schematic illustrations of a device 100 for sealing a projectile guiding kit 90, according to some embodiments of the invention. Reference is also made to FIG. 2E, which is a schematic illustration of a projectile guiding kit 90 and device 100 for sealing projectile guiding kit 90, according to some embodiments of the invention. Reference is also made to FIG. 2F, which is a schematic illustration of a projectile guiding kit 90 and a device 100 for sealing projectile guiding kit 90, prior to and after firing of a projectile 80, according to some embodiments of the invention.

Figure 2A:
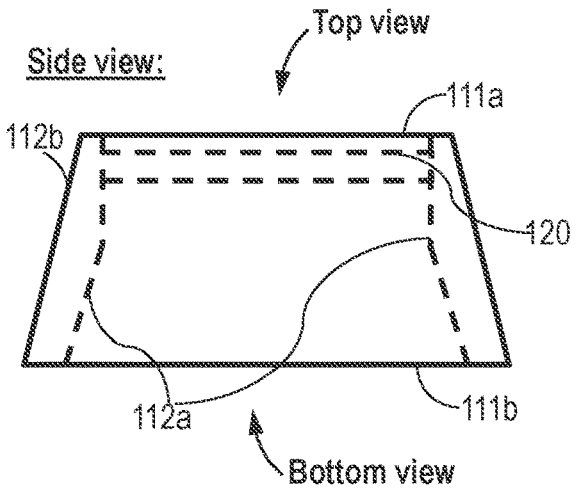
FIGS. 2A, 2B, 2C and 2D are schematic illustrations of a device for sealing a projectile guiding kit, according to some embodiments of the invention.
Figure 2B:
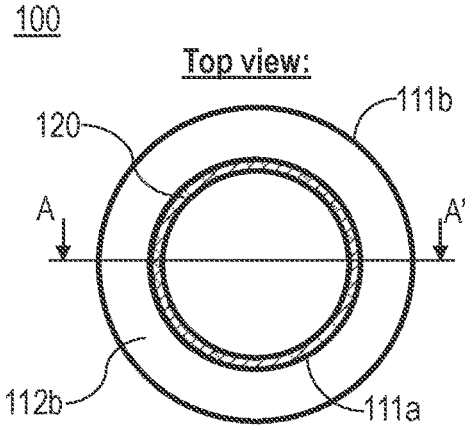
Figure 2C:
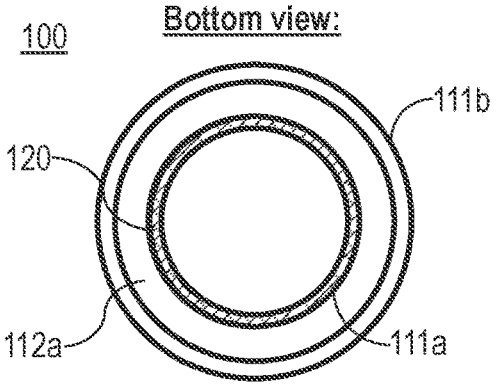
Figure 2D:
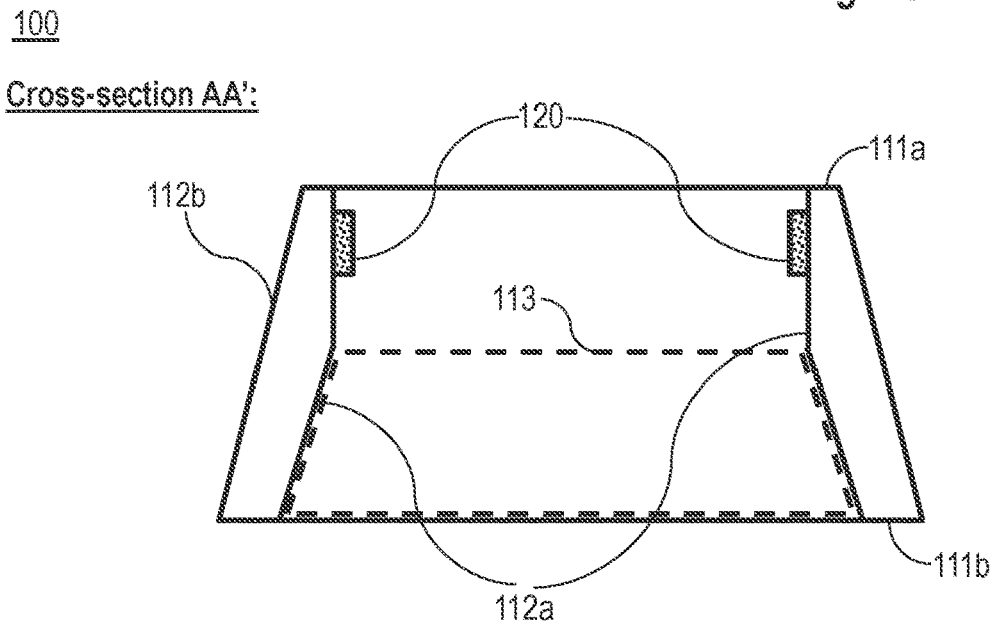
Figure 2E:
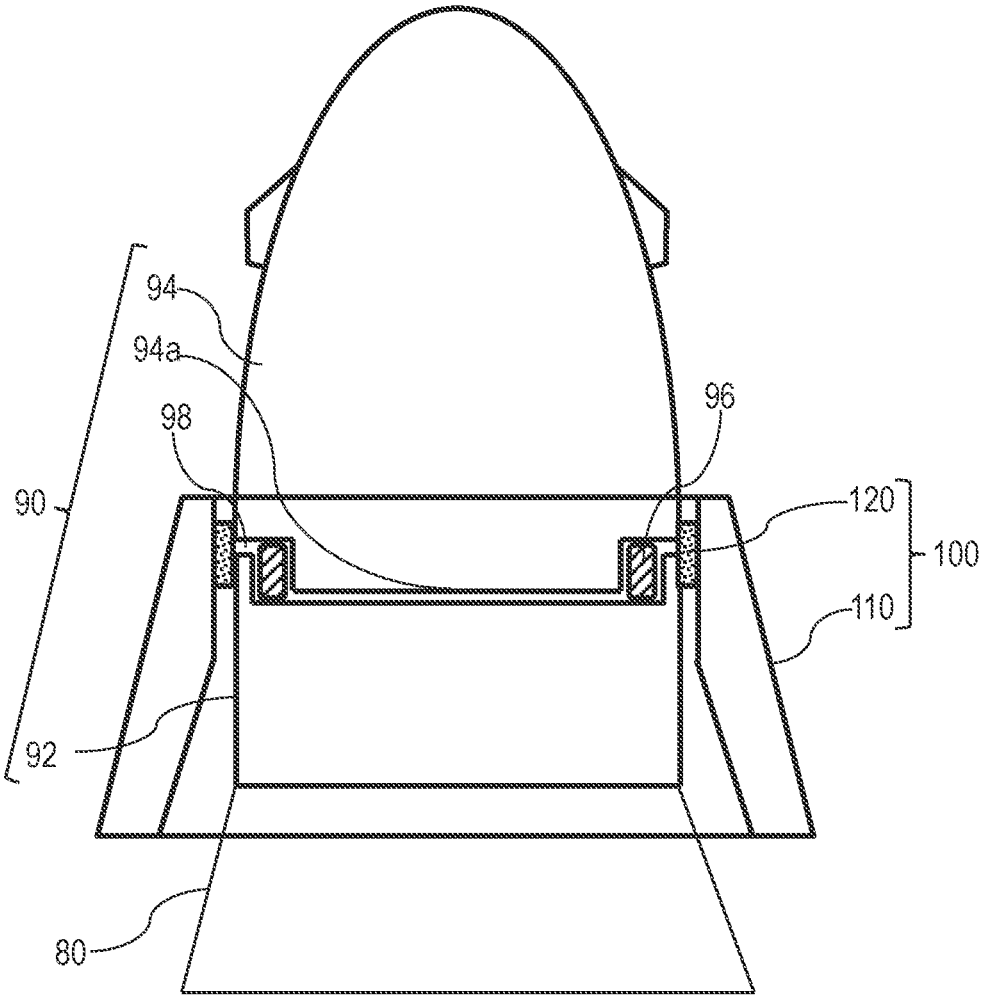
FIG. 2E is a schematic illustration of a projectile guiding kit and a device for sealing the projectile guiding kit, according to some embodiments of the invention.
Figure 2F:
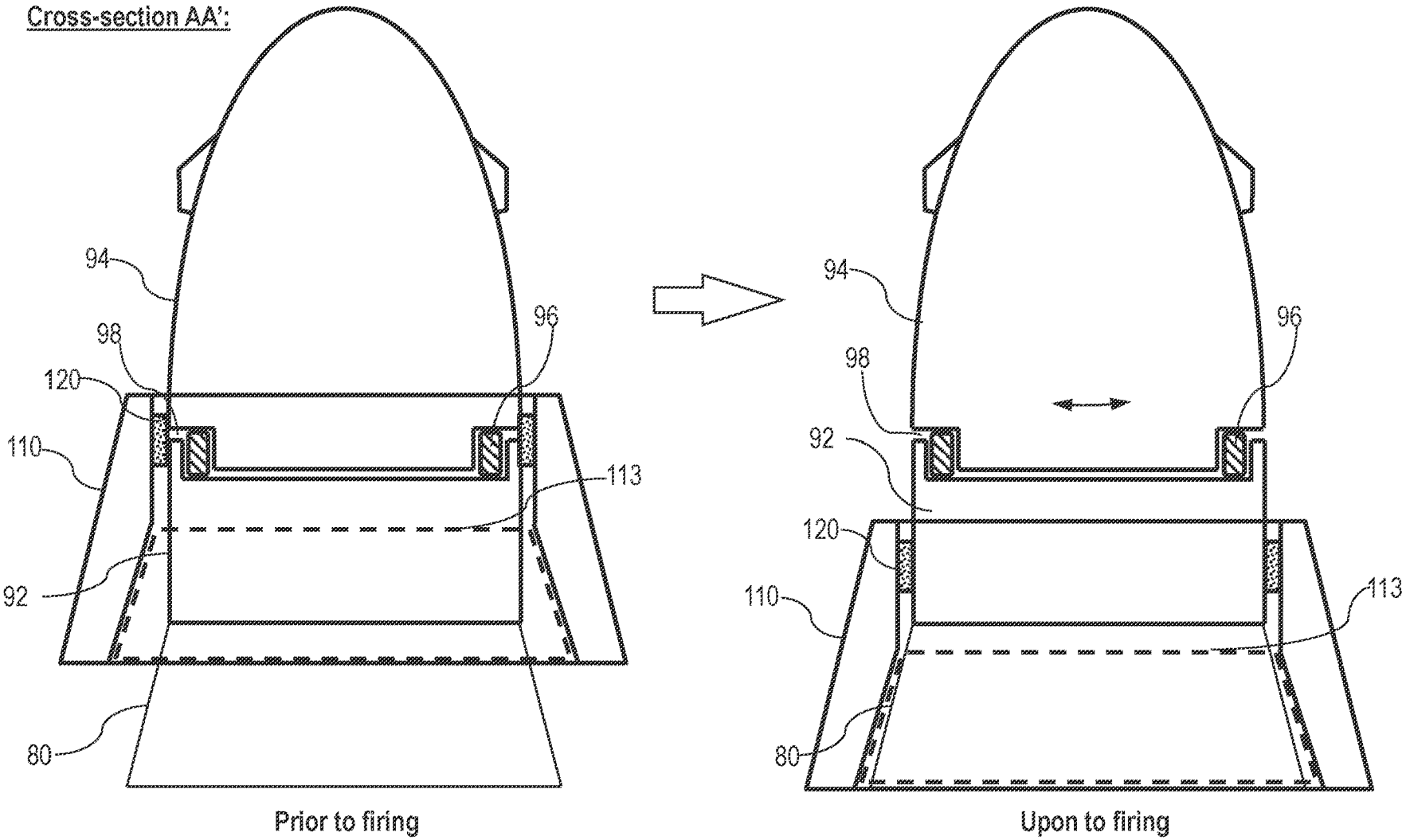
FIG. 2F is a schematic illustration of a projectile guiding kit and a device for sealing the projectile guiding kit, prior to and after firing of a projectile, according to some embodiments of the invention.

FIG. 2A shows a side view. FIG. 2B shows a top view, FIG. 2C shows a bottom view, and FIG. 2D shows a cross-sectional view of device 100. FIGS. 2E and 2F show cross-sectional views of device 100 and of projectile guiding kit 90, respectively.

According to some embodiments, device 100 may be used with any projectile guiding kit having two or more rotatably connectable units. For example, device 100 may be used with projectile guiding kit 90 described above with respect to FIGS. 1A and 1B.

Device 100 may include an annular (or substantially annular) body 110. Annular body 110 may have a front end 111*a*, a rear end 111*b*, an inner side 112*a* and an outer side 112*b* (e.g., as shown in FIG. 2A).

Device 100 may have a flexible ring-shape strip 120. Ring-shape strip 120 may be attached to annular body 110 at inner side 112*a* and adjacent or close to front end 111*a* of annular body 110 (e.g., as shown in FIGS. 2A and 2D). In some embodiments, ring-shape strip 120 is attached to annular body 110 along the entire circumference of inner side 112*a* of annular body 110 (e.g., as shown in FIGS. 2B and 2C). In some embodiments, flexible ring-shape strip 120 may be made of a rubber.

According to some embodiments, annular body 110 of device 100 may be adapted to envelope at least a front portion of rear unit 92 and at least a rear portion of front unit 94 of projectile guiding kit 90. For example, annular body 110 may be adapted to envelope the entire (or substantially entire) rear unit 92 and a portion of front unit 94 of guiding kit 90 that is adjacent to rear end 94*a* of front unit 94 (e.g., as shown in FIG. 2E). Device 100 may be retrofit onto existing projectile guiding kits (e.g., such as guiding kit 90, as shown in FIG. 2E).

Ring-shaped strip 120 may be adapted to tightly seal gap 98 between rear unit 92 and front unit 94 when device 100 is used with guiding kit 90. For example, FIG. 2E shows ring-shape strip 120 sealing gap 98 when annular body 110 envelopes respective portions of rear unit 92 and front unit 94.

Annular body 100 of device 100 may be adapted to slide towards rear unit 92 of guiding kit 90 when subjected to a longitudinal acceleration that exceeds a predetermined acceleration value and/or when subjected to a longitudinal aerodynamic force that exceeds a predetermined longitudinal force value. In some embodiments, the predetermined acceleration value is no less than 1000 G. In some embodiments, the predetermined longitudinal force value is no less than 100 N.

For example, FIG. 2F illustrates sliding of annular body 110 towards rear unit 92 of guiding kit 90 upon firing of projectile 80. The sliding of annular body 110 may uncover gap 98 (e.g., that may be sealed by flexible ring-shape strip 210 prior to firing), thereby enabling uninterrupted rotation of front unit 94 of guiding kit 90 with respect to rear unit 92 thereof.

Upon firing of projectile 80 and during the flight of projectile 80, aerodynamic forces applied on annular body 110 of device 100 may push annular body 110 towards rear unit 92 of guiding kit 90, thereby ensuring that gap 98 between rear unit 92 and front unit 94 thereof remains uncovered to enable uninterrupted rotation of front unit 94 with respect to rear unit 92.

In some embodiments, annular body 110 of device 100 is adapted to slide and rest on projectile 80 upon firing thereof. In these embodiments, a portion 113 of inner side 112*a* that is adjacent to rear end 111*b* of annular body 110 may be adapted in shape and size to receive corresponding portion of projectile 80 (e.g., as shown in FIGS. 2D and 2F). For example, portion 113 may be tapered in a direction extending from rear end 111*b* towards front end 111*a* of annular body 110.

In some embodiments, outer side 112*b* of annular body 130 is tapered in the direction extending from rear end 111*b* towards front end 111*a* of annular body 110 (e.g., as shown in FIGS. 2A, 2D and 2F). The tapered shape thereof may be designed to ensure that annular body 110 does not affect (or substantially does not affect) the aerodynamic parameters of projectile 80 and/or of guiding kit 90.

According to various embodiments, mechanical parameters of device 100 (e.g., of annular body 110 and/or of flexible ring-shape strip 120) are determined to prevent unintended sliding of annular body 110 prior to firing of projectile 80 and also to enable sliding of annular body 110 toward rear unit 92 of guiding kit 90 upon firing of projectile 80 (e.g., as shown in FIG. 2F). The mechanical parameters may, for example, include dimensions, material and/or mechanical properties of annular body 110 and/or of flexible ring-shape strip 120.

For example, dimensions of annular body 110 and/or of flexible ring-shape strip 120 and/or mechanical properties of flexible ring-shape strip 120 may be determined to provide a desired friction force between flexible ring-shape strip 120 and the respective portions of rear unit 92 and front unit 94 of guiding kit 90. In some embodiments, the desired friction force may be no less than 10-50 N.

In this manner, annular body 110 may provide sealing of gap 98 between rear unit 92 and front unit 94 of guiding kit 90 during the entire life time of projectile 80 prior to actual firing thereof without disturbing the operation of guiding kit 90 upon firing and during the flight of projectile 80.

It is noted that, for simplicity and clarity of illustration, elements shown in FIGS. 2A-2F have not necessarily been drawn to scale. It is further noted that the shape and dimensions of device 100 and/or annular body 110 are determined to ensure that device 100 and/or annular body 110 does not affect (or substantially does not affect) the aerodynamic forces applied on and/or the aerodynamic parameters of guiding kit 90 and/or on projectile 80 during flight of projectile 80.

Reference is now made to FIGS. 3A, 3B, 3C and 3D, which are schematic illustrations of a device 100 for sealing a projectile guiding kit 90 and including a trapping unit 140 and at least one front stopper 150, according to some embodiments of the invention. Reference is also made to FIGS. 3E and 3F, which are schematic illustrations of a projectile guiding kit 90 and a device 100 for sealing projectile guiding kit 90 and including a trapping unit 140 and at least one front stopper 150, according to some embodiments of the invention. Reference is also made to FIG. 3G, which is a schematic illustration of a device 100 for sealing a projectile guiding kit 90 and including a trapping unit 140 and at least one front stopper 150, prior to and after firing of a projectile 80, according to some embodiments of the invention.

Figure 3A:
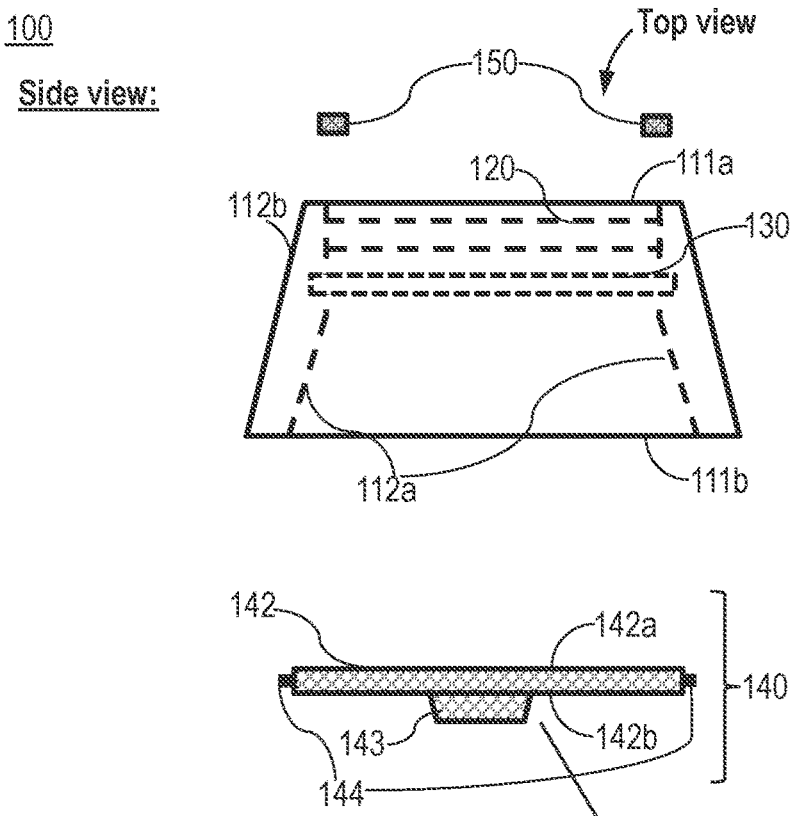
FIGS. 3A. 3B, 3C and 3D are schematic illustrations of a device for sealing a projectile guiding kit and including a trapping unit and at least one front stopper, according to some embodiments of the invention.
Figure 3B:
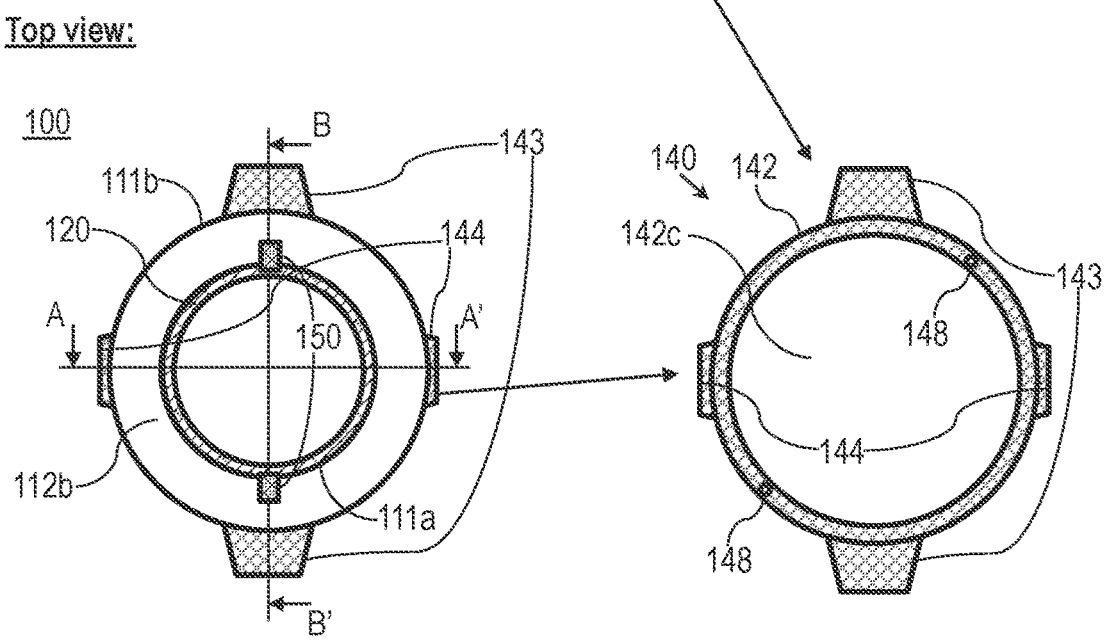
FIGS. 3E and 3F are schematic illustrations of a projectile guiding kit and a device for sealing the projectile guiding kit and including a trapping unit and at least one front stopper, according to some embodiments of the invention.
FIG. 3G is a schematic illustration of a projectile guiding kit and a device for sealing the projectile guiding kit and including a trapping unit and at least one front stopper, prior to and after firing of a projectile, according to some embodiments of the invention.
Figure 3C:
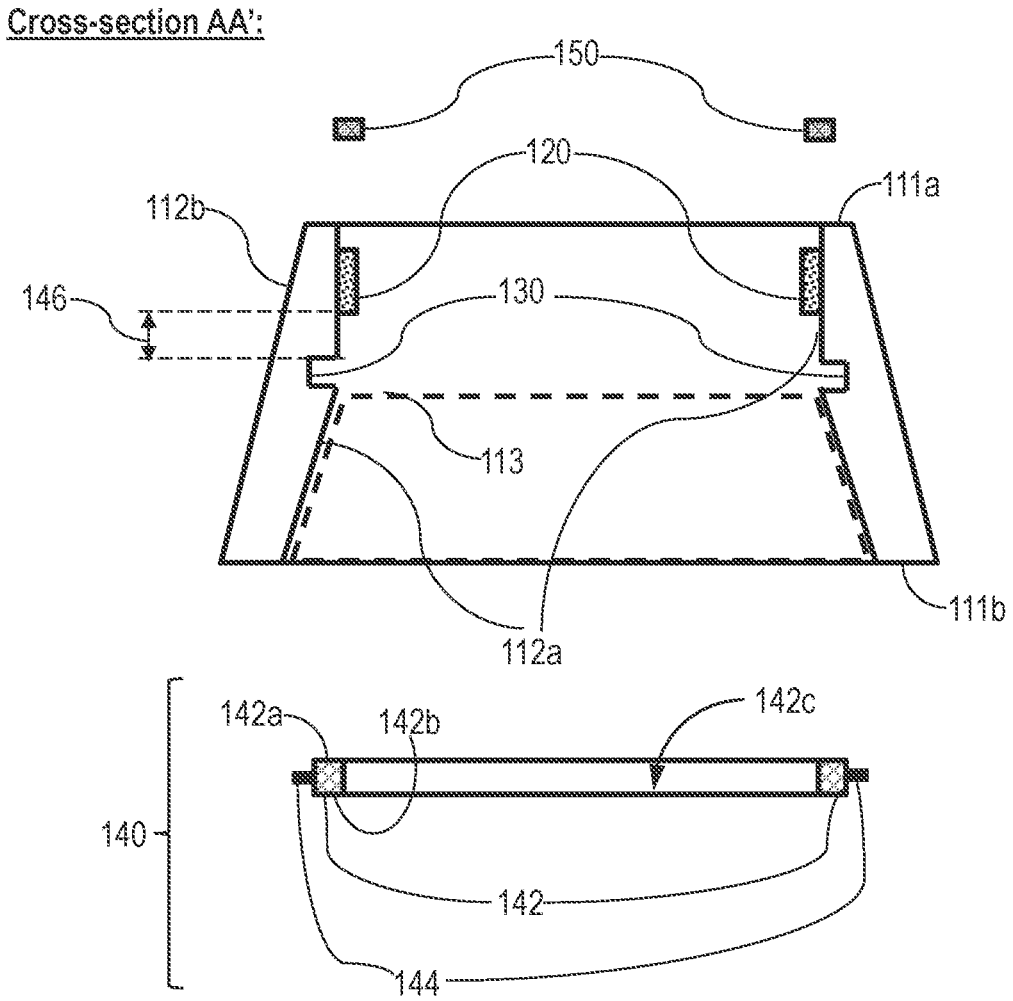
Figure 3D:
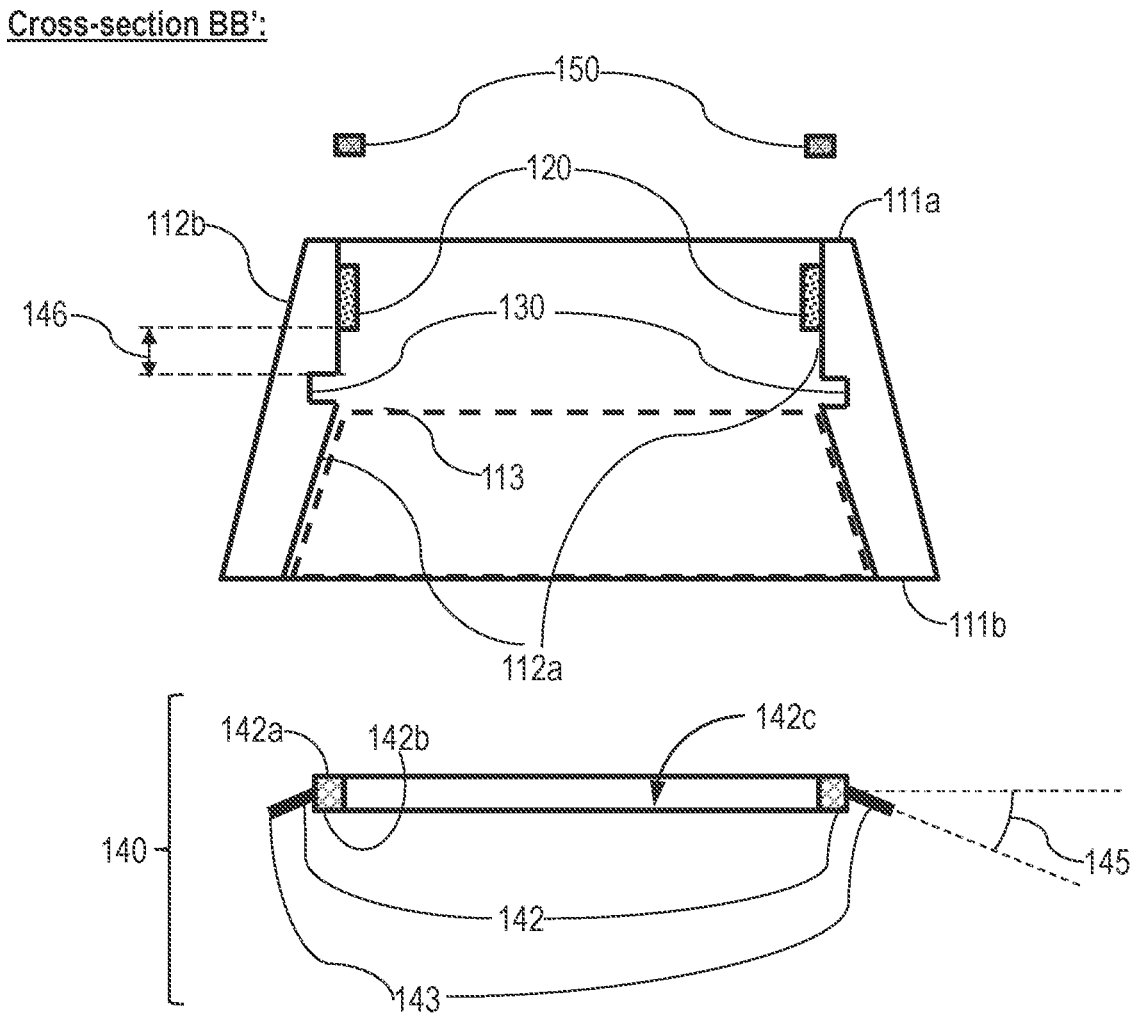
Figure 3F:
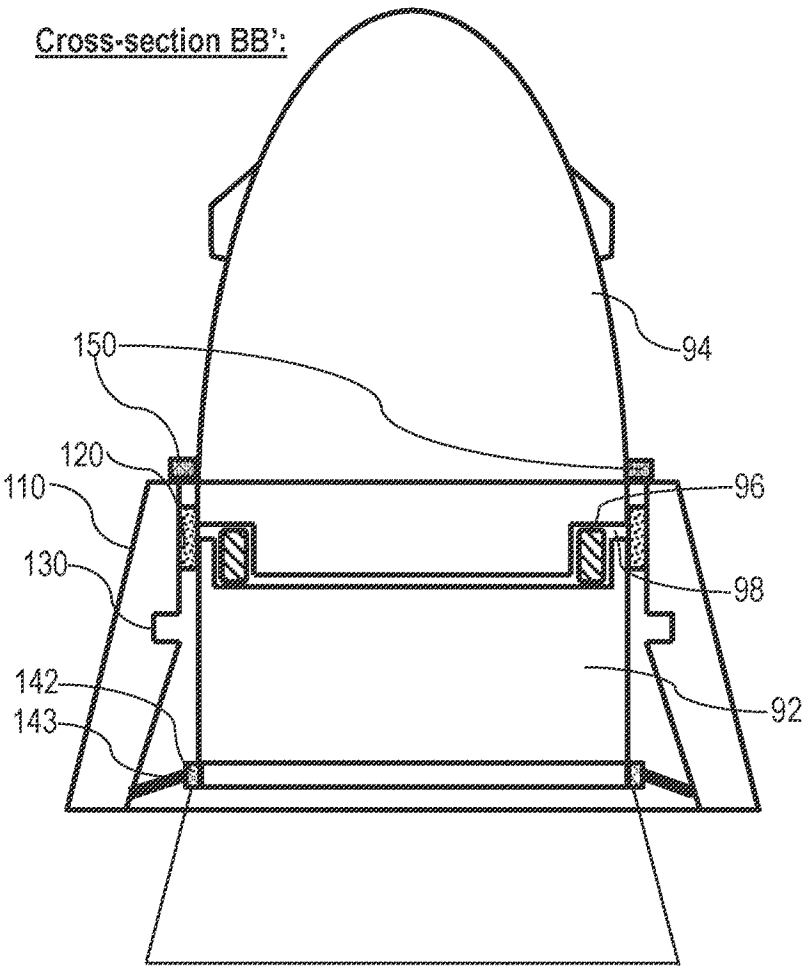
Figure 3E:
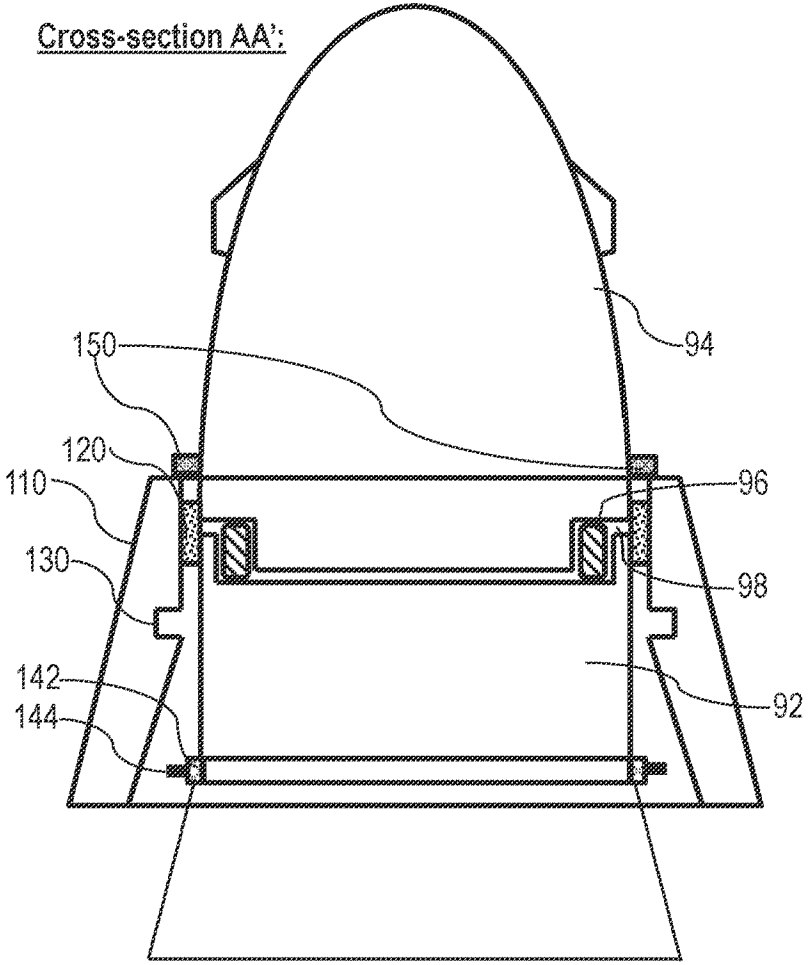
Figure 3G:
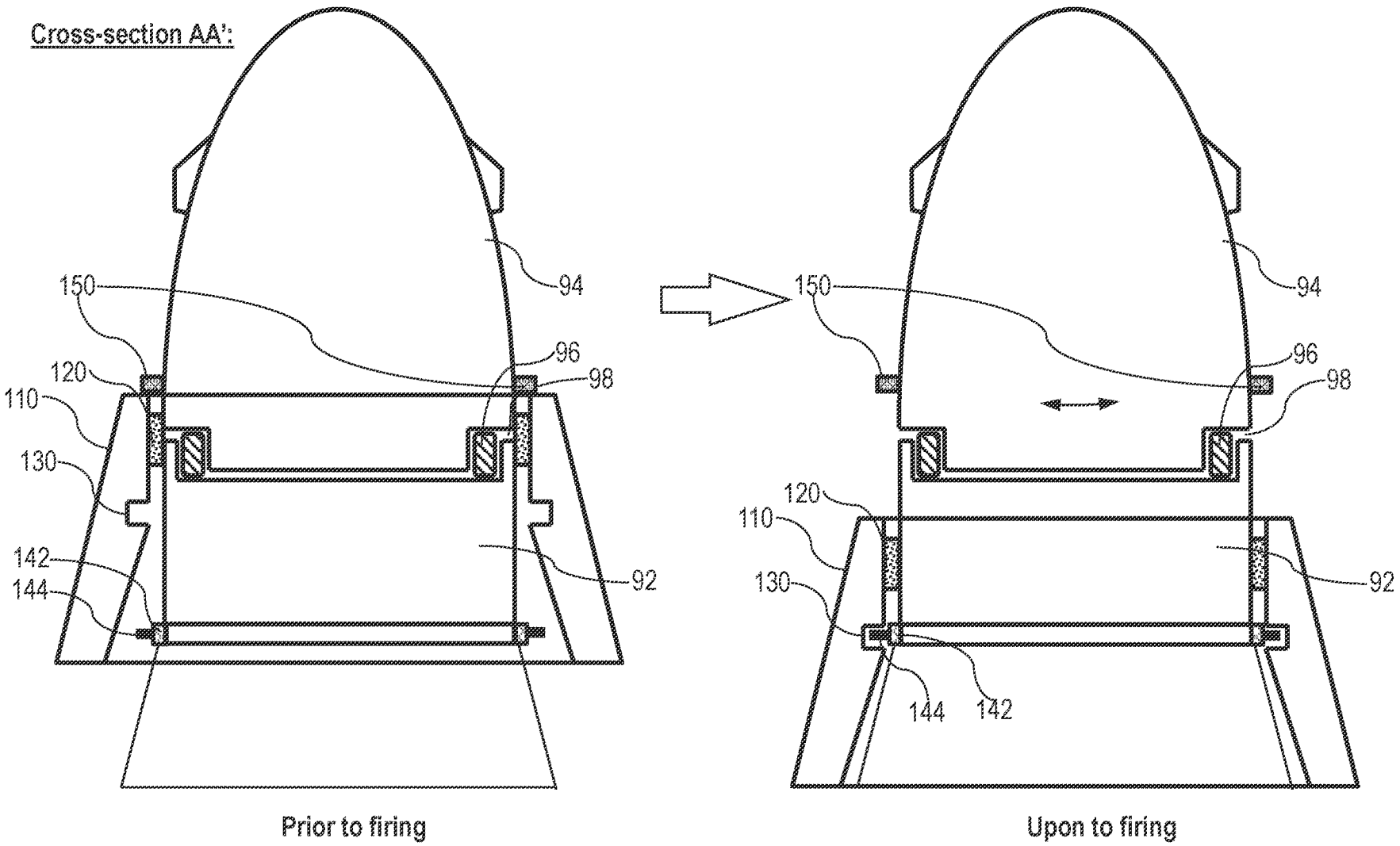

FIG. 3A shows a side view, FIG. 3B shows a top view, FIG. 3C shows a first cross-sectional view and FIG. 3D shows a second cross-sectional view of device 100. FIGS. 3E and 3F show the first cross-sectional view and the second cross-sectional view, respectively, of device 100 and of projectile guiding kit 90, according to some embodiments of the invention. FIG. 3G shows the first cross-sectional view of device 100 and of projectile guiding kit 90 prior to and upon firing of projectile 80.

According to various embodiments, device 100 may include a trapping unit 140 and/or at least one front stopper 150.

According to some embodiments, trapping unit 140 may be adapted to prevent unintentional sliding of annular body 110 towards rear unit 92 of guiding kit 90 prior to firing of projectile 80. This is in addition to the friction forces between flexible ring-shape strip 120 and the respective portions of rear unit 92 and front unit 94 of guiding kit 90 (e.g., as described above with respect to FIGS. 2A-2F).

In some embodiments, trapping unit 140 may be adapted to lock annular body 110 upon sliding of annular body 110 towards rear unit 92 of guiding kit 90, upon firing of projectile 90. In this manner, gap 98 between rear unit 92 and front unit 94 of guiding kit 90 may be kept uncovered upon firing of projectile 80, independently of aerodynamic forces that are applied on annular body 110 during the flight of projectile 80.

According to some embodiments, trapping unit 140 includes an annular (or substantially annular) trapping plate 142, one or more first protrusions 143 and one or more second protrusions 144.

Annular plate 142 may have a front side 142*a* and a rear side 142*b* and a central opening 142*c* (e.g., as shown in FIGS. 3A and 3B). Annular plate 142 may be adapted to be connected to rear unit 92 of guiding kit 90. For example, annular plate 142 may be adapted to be connected to rear end 92*a* of rear unit 92 while yet enabling connection of rear end 92*a* of rear unit 92 to front end 82 of projectile 80 (e.g., as shown in FIGS. 3E and 3F). In some embodiments, annular plate 142 may include one or more holes 148 to enable connection of annular plate 142 to rear unit 92 of guiding kit 90 (e.g., as shown in FIG. 3B).

First protrusion(s) 143 may generally protrude outwards from annular plate 142 (e.g., as shown in FIGS. 3A, 3B, 3D and 3F). In some embodiments, first protrusion(s) 143 are inclined at a predetermined angle 145 with respect to a plane of annular plate 142 in a direction extending from front side 142*a* to rear side 142*b* of annular plate 142 (e.g., as shown in FIGS. 3A and 3D). Angle 145 is indicated in FIG. 3D only (for sake of clarity). In some embodiments, angle 145 ranges between 20°-35°.

First protrusion(s) 143 may be arranged to support annular body 110 (or at least rear end 111*b* of annular body 110) prior to firing of projectile 80 (e.g., as shown in FIG. 3F), while enabling sliding of annular body 110 towards rear unit 92 of guiding kit when subjected to the predetermined longitudinal acceleration and/or the predetermined longitudinal force.

Second protrusion(s) 144 may generally protrude outwards from annular plate 142 (e.g., as shown in FIGS. 3A, 3B and 3C). In the embodiments of FIGS. 3A, 3B and 3C, annular body 110 of device 100 may further include an indent 130 (e.g. a circular indent) made on inner side 112*a* of annular body 110, between ring-shaped strip 120 and rear end 111*b* of annular body 110 and at a predetermined distance 146 with respect to ring-shaped strip 120 (e.g., as shown in FIGS. 3A-3C). Distance 146 is indicated in FIG. 3D only (for sake of clarity). In some embodiments, indent 130 is made along at least a portion of the circumference of inner side 112*a* of annular body 110.

Annular plate 142 and/or first protrusion(s) 143 and/or second protrusion(s) 144 may be made of, for example, flexible/bendable metal. The mechanical parameters of the flexible/bendable metal may be determined to enable mostly plastic (e.g., irreversible) bending of first protrusion(s) 143 and/or of second protrusion(s) 144 when, for example, a force applied thereon by annular body 110, exceeds a predetermined force value (e.g., force of 100 N, for example upon firing of projectile 80) while yet enabling a desired measure of elastic deformation of first protrusion(s) 143 and/or of second protrusion(s) 144 upon the plastic bending thereof.

Upon firing of projectile 80, annular body 110 of device 100 may slide towards rear unit 92 of guiding kit 90, while bending first protrusion(s) 143 and/or second protrusion(s) 144 and enabling second protrusion(s) 144 to enter into indent 130 of annular body 110, thereby locking annular body 110 with respect to rear unit 92. The distance between indent 130 and ring-shaped strip 120 may be determined based on dimensions of annular body 110 and/or of rear unit 92 to ensure that when annular body 110 is locked with respect to rear unit 92 by second protrusion(s) 144 of annular plate 142, gap 98 remains uncovered (e.g., as shown in FIG. 3G).

According to some embodiments, front stopper(s) 150 may be adapted to be connected to front unit 94 of guiding kit 90 (e.g., as shown in FIGS. 3A-3G). Front stopper(s) 150 may prevent unintended sliding of annular body 110 of device 100 towards front unit 94 of guiding kit 90.

According to some embodiments, relative positions of annular plate 142/first protrusion(s) 143 of trapping unit 140 with respect to front stopper(s) 150 may be determined to ensure that ring-like strip 120 attached to annular body 110 tightly seals gap 98 between rear unit 92 and front unit 94 of guiding kit 90 prior to firing of projectile 80.

It is noted that, for simplicity and clarity of illustration, elements shown in FIGS. 3A-3G have not necessarily been drawn to scale. It is further noted that the shape and dimensions of device 100 and/or annular body 110 are determined to ensure that device 100 and/or annular body 110 does not affect (or substantially does not affect) the aerodynamic forces applied on and/or the aerodynamic parameters of guiding kit 90 and/or on projectile 80 during flight of projectile 80.

Figure 4A:
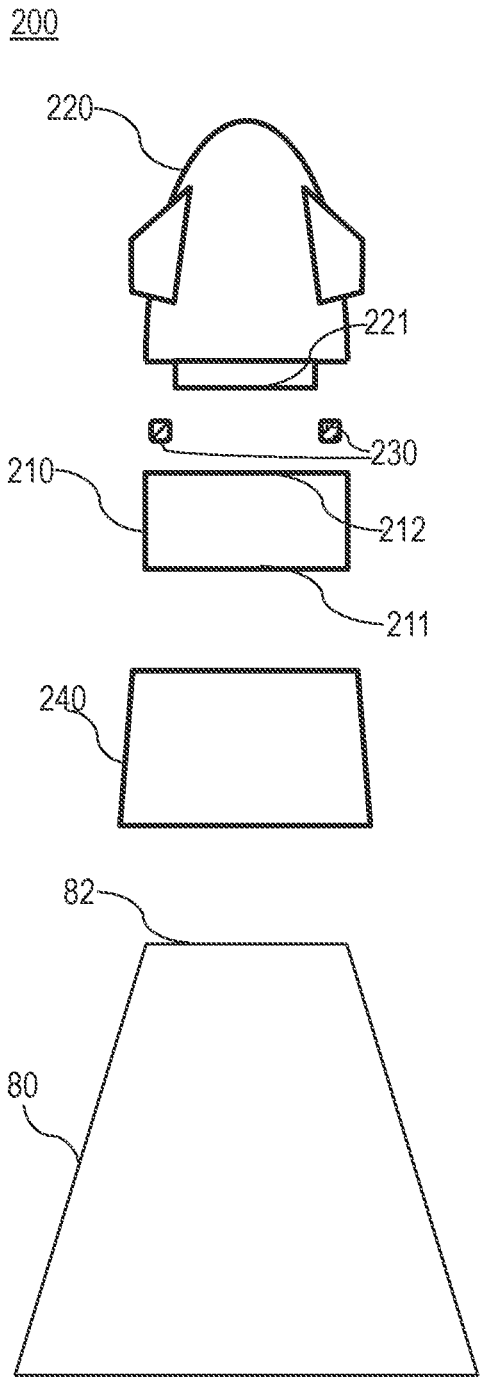
FIGS. 4A and 4B are schematic illustrations of a projectile guiding kit for a projectile, according to some embodiments of the invention.
Figure 4B:
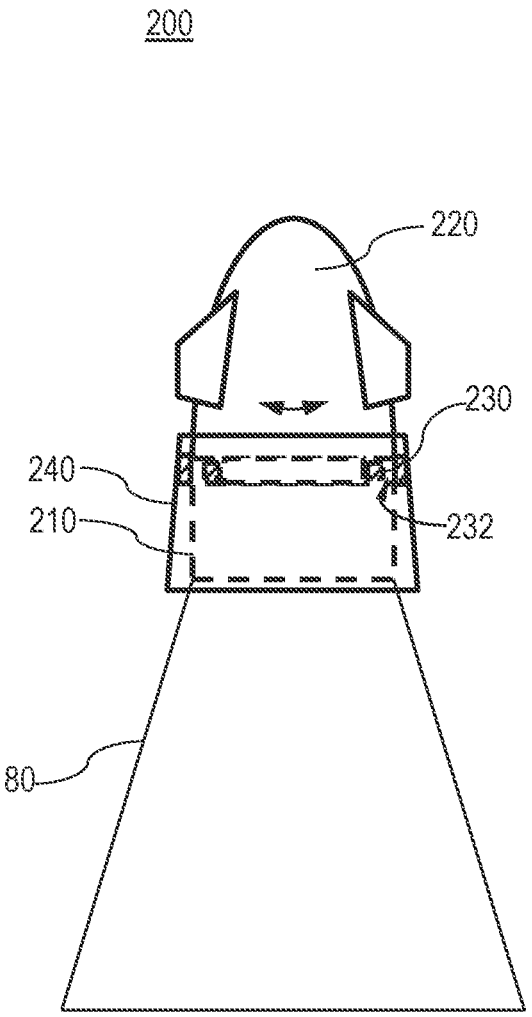

Reference is now made to FIGS. 4A and 4B, which are schematic illustrations of a projectile guiding kit 200 for a projectile 80, according to some embodiments of the invention. FIG. 4A shows and exploded side view, and FIG. 4B shows an assembled side vide of guiding kit 200.

According to some embodiments, projectile guiding kit 200 includes a rear unit 210 adapted to be connected at its rear end 211 to a front end 82 of a projectile 80 and a front unit 220 rotatably connected at its rear end 221 to a front end 212 of rear unit 210. Projectile guiding kit 200 may have one or more bearings 230 positioned within, or proximal to, a gap 232 between rear unit 210 and front unit 220 to enable the uninterrupted rotation of front unit 220 with respect to rear unit 210.

According to some embodiments, projectile guiding kit 200 includes a device 240 for sealing projectile guiding kit 200. Device 240 may be similar to device 100 described above with respect to FIGS. 2A, 2B, 2C, 2D, 2E and 2F and FIGS. 3A, 3B, 3C, 3D, 3E, 3F and 3G.

Advantageously, the disclosed device for sealing projectile guiding kits needs not be removed from the guiding kit connected to the projectile prior to firing of the projectile. For example, the projectile may be fed into a firing chamber of a weapon without detaching/releasing the device from the guiding kit. Accordingly, the disclosed device may seal sensitive elements of the projectile guiding kit (such as bearing(s) between the rear unit and the front unit thereof) all the way up to actual firing of the projectile. Furthermore, the disclosed device may save time and reduce personnel's effort required to prepare the projectile for firing and/or enable usage of the guiding kit with projectile for automatic weapons. This in contrast to current covering for the projectile guiding kit that has to be manually released/detached from the guiding kit prior to feeding the projectile into the weapon's firing chamber.

Figure 5A:
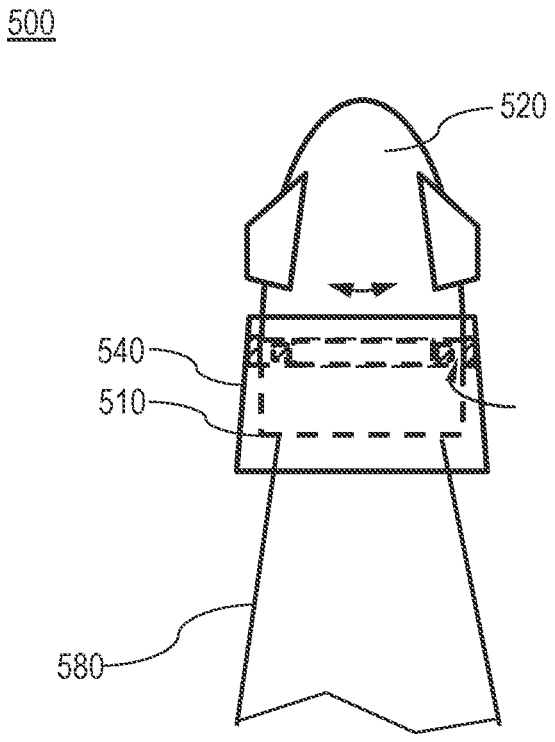
FIGS. 5A and 5B schematically depict projectile 500 showing a protective sleeve in a frontal and rear position, respectively, according to embodiments of the invention.
Figure 5B:
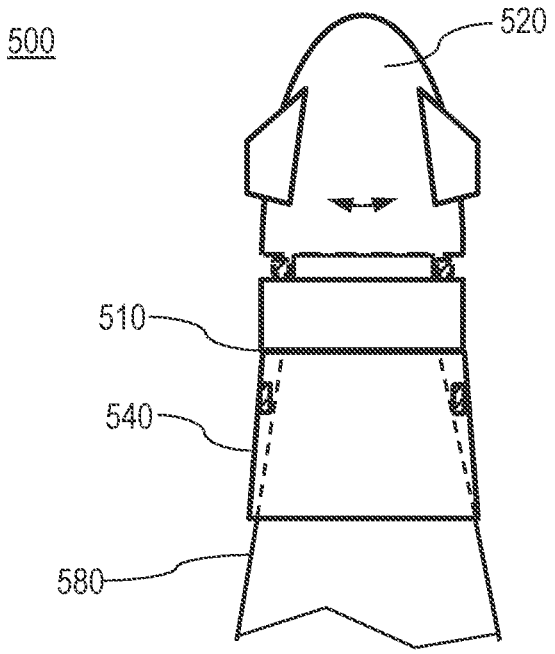

In some known conditions, a cannon shell and a projectile may be equipped with an oversized warhead, that is the—outer diameter of the warhead (the front part of the object, with respect to the trajectory direction) may be substantially different from that of the projectile, and typically larger than that of the projectile at the rearmost end of the projectile, where the warhead is adapted to be installed on. FIGS. 5A and 5B schematically depict projectile 500 showing a protective sleeve in a frontal and rear position, respectively, according to some embodiments of the invention. Projectile 500 may have projectile body 580, a warhead comprised of a frontal part 520 and rear part 510 and a protective sleeve 540. The warhead shown here is a guiding head and front part 520 is adapted to spin with respect to back part 510.

In other embodiments, the shape of the warhead is such that, when it is installed on the projectile frontend it creates, at the plane were the warhead meets the projectile, an external profile with deteriorated aerodynamic feature, due to sharp change in the envelope shape.

Figure 6A:
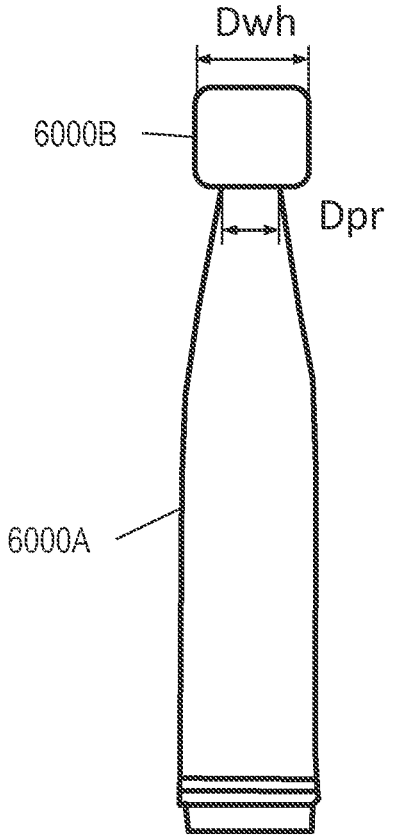
FIGS. 6A and 6B schematically depict two different configurations of cannon shell and projectile.
Figure 6B:
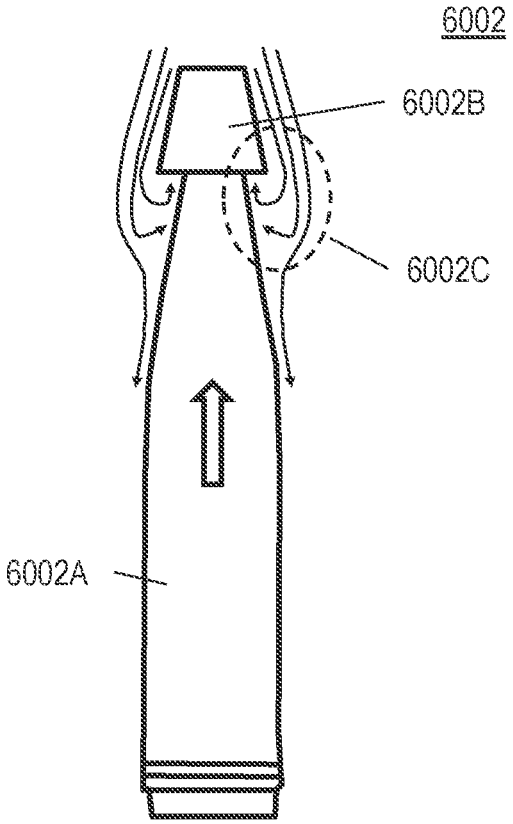

Reference is made to FIGS. 6A and 6B, which schematically depict two different configurations of cannon shell and projectile—projectiles 6000, 6002 with projectile body 6000A, 6002A, respectively, and projectile warhead 6000B, 6002B, respectively. Projectiles 6000 and 6002 may have outer diameter $D_{PR}$ of the projectile front part and may have outer diameter $D_{WH}$ of the projectile warhead, where $D_{WH}>D_{PR}$. In such configurations, the sharp change of the outer profile, where warhead 600B, 6002B is attached to projectile body 600A, 6002A (respectively), causes aerodynamic disturbances, for example in the form of turbulences 6002C, that in turn consume energy from the fired projectile in flight and may cause instability to its flight—both are undesired phenomena. There is a need to reduce the undesired effect of the sharp change in the projectile's profile. According to some embodiments of the invention, a slidable sleeve may be disposed proximal to the plane where the projectile warhead is attached to the projectile body, in a way that will enable to position the sleeve over the area of the sharp change, also named herein after the target position, so that the sleeve actually smooths the sharp change and improves the aerodynamic profile at that location. According to some embodiments of the invention, the sleeve may be positioned initially at a location distal from the target location and may be positioned at later stage in the target position.

Figure 6C:
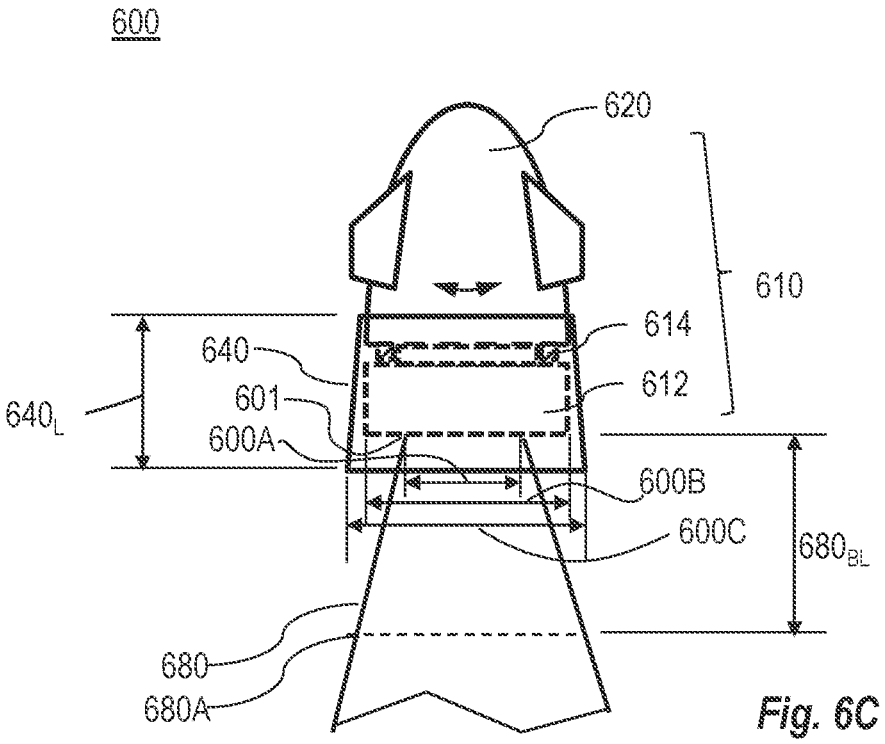
FIGS. 6C and 6D schematically illustrate partial view of a front part of a projectile in pre-firing position and in after firing position, respectively, according to embodiments of the present invention
Figure 6D:
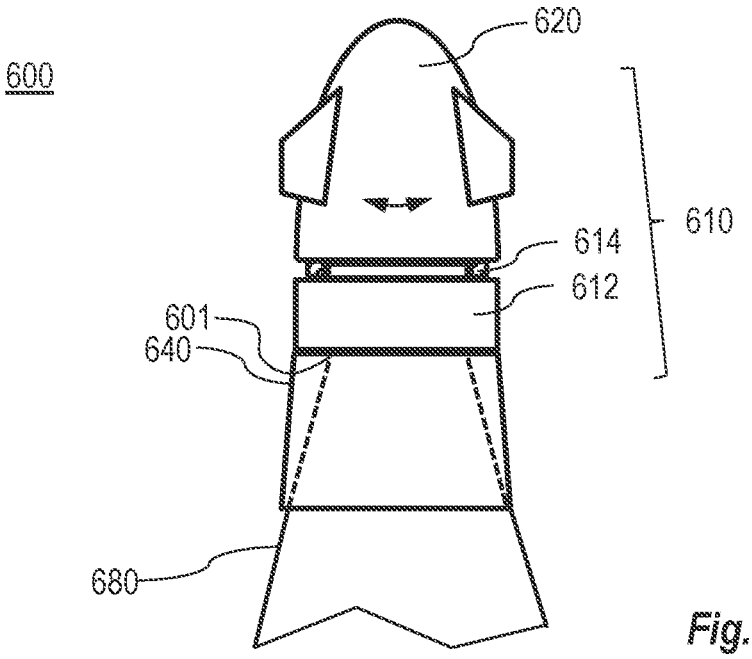

Reference is made now to FIGS. 6C and 6D, which schematically illustrate partial view of a front part of a projectile 600, in pre-firing position and in after firing position, respectively, according to embodiments of the present invention. Projectile 600 is a comprises projectile body 680 (shown only at its frontal portion) with a front end shaped as a cone with its smaller diameter at the front most end, and warhead 610 which comprises guiding unit comprised of rear part 612 and front part 620 which is rotatably connected to rear part 612 by bearing assembly 614. Front part 620 is adapted to rotate with respect to projectile body 630 and rear part 612, for example due to the aerodynamic forces acting on the fins of front part 620 when the projectile is in flight. In some embodiments, the outer diameter 600B of rear part 612 of warhead 610 is bigger than the outer diameter 600A of the front part of projectile body 680. As discussed above, the sharp change of the projectile's profile 601, where rear part 612 of warhead 610 is attached to front end of projectile body 680, produces undesired turbulences.

According to some embodiments of the invention, protective sleeve 640 may be disposed over the rear end of warhead 610 such that, when it is in its frontal position, as depicted in FIG. 6C, it covers the bearing assembly 614 and remains detached from front end of projectile body 680. After firing of projectile 600, protective sleeve 640 slides backwards due to, for example, the extremely high acceleration force during the firing. As a result, sleeve 640 slides off front part 620 of warhead 610 and may find rest where its rear end reaches location 680A on front end of projectile body 680, where the diameter of projectile body 680 fits diameter 600C of the rear end of protective sleeve 640. The distance between the front end of projectile body 680 and location 680A is defined $\mathbf{680}_{BL}$. Thus, protective sleeve 640 extends, after firing, from rear end 612 of warhead 610 to location 680A on front end of projectile body 680, thereby covers the location of sharp change 601 and smooths the aerodynamic profile there. While sleeve 640 in FIGS. 6C and 6D is presented having a substantially annular cut-off cone shape, it would be apparent that, in accordance with some embodiments of the invention, sleeve 640 may have different shapes, as long as its front end smoothly fits the outer diameter 600B of rear end 612 of warhead 610, and its rear end smoothly fits the diameter of projectile body 680 at location 680A. For example, the sideline of sleeve 640 may differ from a straight line and may be shaped as a slight curve—as may be dictated by respective aerodynamic considerations. Protective sleeve may have a length $\mathbf{640}_L$ between its front and rear end.

The embodiment presented above, with regard to FIGS. 6C and 6D, may be useful for projectile with a rotating warhead, such as warhead with guiding assembly. In other embodiments, the warhead may have an outer diameter larger than the outer diameter of the front end of the projectile but without a guiding assembly, or in any event without a rotating front end of the warhead. In such embodiments, there is no need to protect the bearing assembly prior to the firing and thus—no need to provide a sliding back sleeve in response to the firing acceleration forces.

Figure 6E:
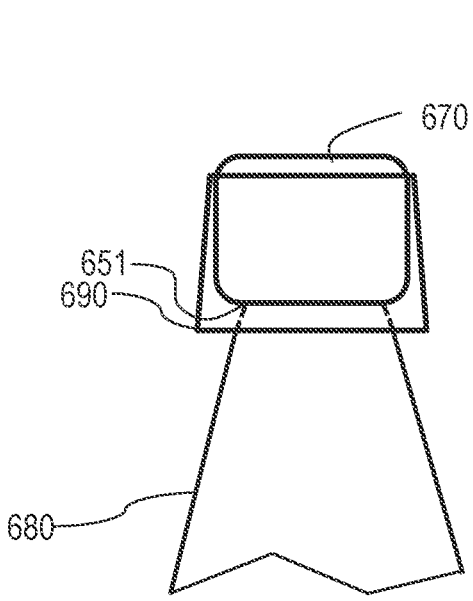
FIGS. 6E and 6F are schematic illustrations of a projectile in initial state and in final state of installation of warhead, respectively, according to embodiments of the invention.
Figure 6F:
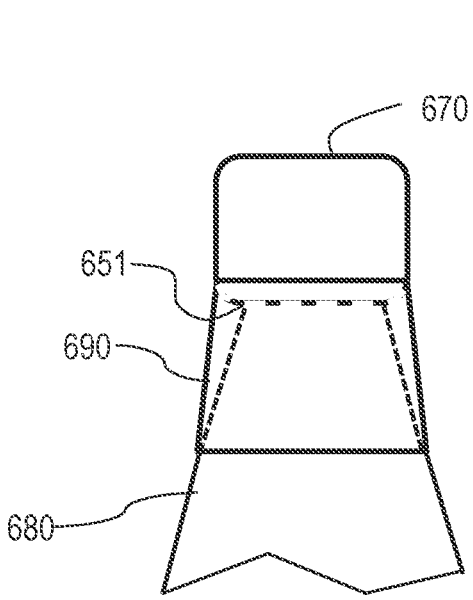

Reference is made now to FIGS. 6E and 6F, which are schematic illustrations of projectile 650 (only front end is shown) in initial state and final state of installation of warhead, respectively, according to some embodiments of the invention. Warhead 670 may be any installable warhead adapted to be screwed (or otherwise be tightly installed onto projectile body 680). Warhead 670 may have an outer diameter larger than that of the front end of projectile body 680, thereby creating a sharp change 651 in the aerodynamic profile of projectile 650, similarly to the situation explained with respect to FIGS. 6C and 6D. Protective sleeve 690 may be installed onto the outer face of warhead 670 in a way the will enable a user to slide it backwardly (with respect to the firing direction) either manually or with the assistance of a dedicated tool. Protective sleeve 690 may be provided as an integral part of warhead 670, or may be provided as an add-on part, adapted to fit onto a selected warhead type. During the pre-firing stow period, protective sleeve may be kept apart from warhead 670 or installed on it, as it may fit logistical and operational considerations. Prior to installation of the warhead onto the projectile body, protective sleeve 690 should be placed on warhead 670 so that it is closer to its front end than to its rear end. After warhead 670 has been tightly attached to projectile body 680, protective sleeve 690 may be slid backwardly, manually or with the assistance of a dedicated tool. Protective sleeve 690 should be slid backwardly until it reaches location on projectile body 680 where it tightly surrounds its circumference (at location analogous to location 680A of FIG. 6C). While sleeve 690 in FIGS. 6E and 6F is presented having a substantially cone shape, it would be apparent that, in accordance with some embodiments of the invention, sleeve 690 may have different shapes, as long as its front end smoothly fits the outer diameter of rear end of warhead 670, and its rear end smoothly fits the diameter of projectile body 680 at location 680A. For example, the sideline of sleeve 690 may differ from a straight line (as is the case in a cone) and may be shaped as a slight curve—as may be dictated by respective aerodynamic considerations. In the case where the attachment of the warhead to the projectile body is done by means of a thread, the warhead may be threaded onto the projectile body while the protective sleeve is in its forward position (see FIG. 6E), and only after the warhead has been securely attached to the projectile body, the protective sleeve may be slid backwardly to its rear position, thereby forming an aerodynamic cover to the point of sharp change in the aerodynamic profile.

In some embodiments, means for securing the sleeve in its frontal position (as presented in FIG. 6E) and in its rear position (as is presented in FIG. 6F) may be provided.

Figure 7A:
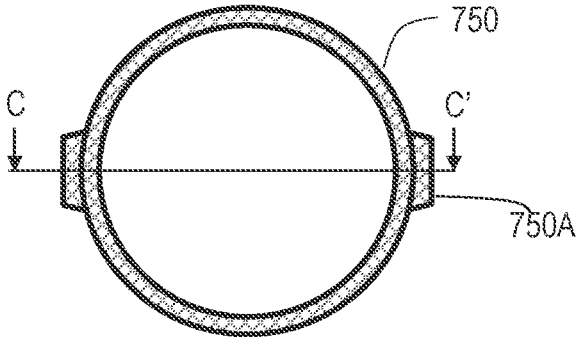
FIGS. 7A and 7B are schematic top view and cross section view, respectively, of secure-and-lock ring according to embodiments of the invention.
Figure 7B:
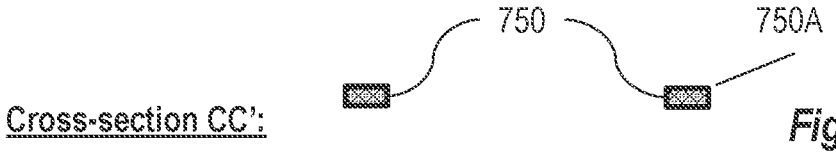

Reference is made to FIGS. 7A and 7B, which are schematic top view and cross section view, respectively, of secure-and-lock ring 750 according to some embodiments of the invention. Ring 750 may be disposed between a protective sleeve and the projectile similarly to trapping unit 140, which is discussed above with respect to FIGS. 3A-3G. However, different from trapping unit 140, secure-and-lock ring 750 performs both securing the protective sleeve in its initial (frontal) position and locking it in its final (rear) position, as described herein. Ring 750 may comprise two (or more) lugs 750A protruding outwardly from the ring outer circumference. The diameter of the outer circumference of ring 750 may be equal or very close to the inner diameter of a protective sleeve, e.g. sleeve 680 of FIGS. 6E and 6F.

Figure 7D:
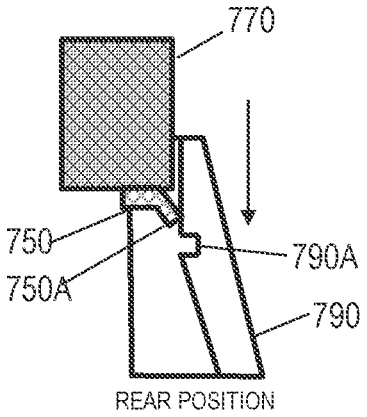
FIGS. 7C and 7D are partial cross section views of sleeve 790 in its frontal position and rear position, respectively, according to embodiments of the invention.
Figure 7C:
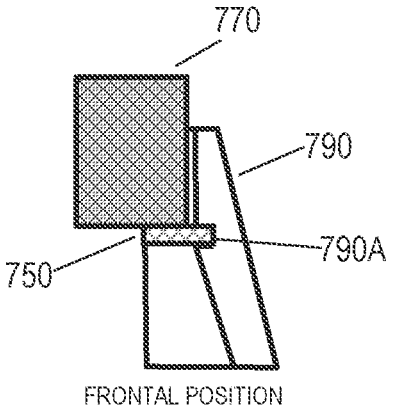

Reference is made now also to FIGS. 7C and 7D, which are partial cross section views of sleeve 790 in its frontal position and rear position, respectively, according to some embodiments of the invention. The cross section is made parallel to a virtual longitudinal center line of the projectile according to some embodiments of the present invention. Partial cross section of the warhead is presented by element 770 and partial cross section of a protective sleeve is presented by element 790. A dent 790A may be made in the inner face of sleeve 790. Dent 790A may be, in some embodiments a circular slot made around the inner face of sleeve 790. The location of dent 790A matches the location of ring 750 when sleeve 790 is in its frontal position, as shown in FIG. 7C, in the frontal position lugs 750A are inserted into dent 790A, thereby securing sleeve 790 in its frontal position. In order for sleeve 790 to be moved backward, either due to high inertial forces (during firing of the projectile) or manually after installation of a warhead onto a projectile body, it is needed to apply a predetermined force by moving sleeve 790 backwardly. As a result, lugs 750A bend as shown in FIG. 7D and touch the inner face of sleeve 790 at a predetermined angle. The predetermined angle may be set so that the edge of lugs 750A that touches the inner face of sleeve 790 exerts stopping force preventing sleeve 790 from moving forward. The exact angle between the bent lug and the inner face of sleeve 790 may be determined taking in consideration the sharpness of the edge of lug 790A, the material of which it is made, the material of sleeve 790 and the smoothness of the inner face of sleeve 790. It would be apparent to those skilled in the art that one or more lugs 750A may be needed to provide the 'secure-and-lock' functionality. In other embodiments, one lug may be used to provide the 'secure' functionality and one lug may be used to provide the 'lock' functionality.

In the above description, an embodiment is an example or implementation of the invention. The various appearances of "one embodiment", "an embodiment", "certain embodiments" or "some embodiments" do not necessarily all refer to the same embodiments. Although various features of the invention can be described in the context of a single embodiment, the features can also be provided separately or in any suitable combination. Conversely, although the invention can be described herein in the context of separate embodiments for clarity, the invention can also be implemented in a single embodiment. Certain embodiments of the invention can include features from different embodiments disclosed above, and certain embodiments can incorporate elements from other embodiments disclosed above. The disclosure of elements of the invention in the context of a specific embodiment is not to be taken as limiting their use in the specific embodiment alone. Furthermore, it is to be understood that the invention can be carried out or practiced in various ways and that the invention can be implemented in certain embodiments other than the ones outlined in the description above.

The invention is not limited to those diagrams or to the corresponding descriptions. Meanings of technical and scientific terms used herein are to be commonly understood as by one of ordinary skill in the art to which the invention belongs, unless otherwise defined. While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. A device for improving the aerodynamic feature of a projectile having a front part and a rear part, wherein the external diameter of the front part of the projectile is larger than the external diameter of the front end of a rear part of the projectile and wherein the front end of the rear part of the projectile is conical having larger diameter at locations behind the front end, the device comprising:

an annular cut-off cone sleeve slidably disposable over the front part of the projectile, wherein the diameter of the narrower end of the annular cone sleeve is slightly larger than the diameter of the front part of the projectile, and wherein the length of the annular cut-off cone sleeve is larger than the distance between the front end of the rear part of the projectile and a location on rear part having a diameter equal to the diameter of the rear end of the annular cut-off cone sleeve.

2. The device of claim 1, wherein the annular cut-off cone sleeve is adapted to slide from a rearmost position backwardly in response to longitudinal firing acceleration force.

3. The device of claim 1, wherein the annular cut-off cone sleeve is adapted to slide from a rearmost position backwardly in response to manually operated force.

4. The device of claim 1 wherein the annular cut-off cone sleeve comprises a dent made in its internal face at a location facing against the rear end of the front part of the projectile when the cone sleeve is in its frontmost position.

5. The device of claim 1 further comprising a secure-and-lock ring disposed between the front part and the rear part of the projectile, the secure-and-lock ring comprises at least one lug protruding from the ring outer circumference.

6. The device of claim 5, wherein the at least one dent is located in the dent of the cone sleeve when the cone sleeve is in its frontmost position.

7. The device of claim 6, wherein the at least one dent is adapted to bent in response to sliding of the cone sleeve backwardly.

8. The device of claim 7 wherein the at least one dent is adapted to touch the inner face of the cone sleeve when it is bent in a defined angle.

* * * * *